US006896493B2

(12) United States Patent
Chang et al.

(10) Patent No.: US 6,896,493 B2
(45) Date of Patent: May 24, 2005

(54) SCROLL COMPRESSOR

(75) Inventors: Young Il Chang, Seoul (KR); Yang Hee Cho, Seoul (KR); Myung Kyun Kim, Inchon-kwangyok-shi (KR); Yoo Chol Ji, Inchon-kwangyok-shi (KR)

(73) Assignee: LG Electronics Inc., Seoul (KR)

( * ) Notice: Subject to any disclaimer, the term of this patent is extended or adjusted under 35 U.S.C. 154(b) by 108 days.

(21) Appl. No.: 10/372,255

(22) Filed: Feb. 25, 2003

(65) Prior Publication Data

US 2004/0042917 A1 Mar. 4, 2004

(30) Foreign Application Priority Data

Aug. 27, 2002 (KR) ..... P10-2002-0050906
Aug. 27, 2002 (KR) ..... P10-2002-0050907
Aug. 27, 2002 (KR) ..... P10-2002-0050908
Aug. 27, 2002 (KR) ..... P10-2002-0050909

(51) Int. Cl.[7] ..... F04B 17/03

(52) U.S. Cl. ..... 417/410.5; 310/51; 310/266; 418/94

(58) Field of Search ..... 417/410.5, 415, 417/410.3, 424.1, 424.2; 310/51, 266; 418/94

(56) References Cited

U.S. PATENT DOCUMENTS 3,134,037 A * 5/1964 Upton ..... 310/266
5,370,509 A * 12/1994 Golding et al. ..... 417/423.7
6,036,456 A * 3/2000 Peters et al. ..... 417/423.7
6,135,738 A * 10/2000 Kajiwara et al. ..... 418/94
6,400,060 B1 * 6/2002 Pfleuger et al. ..... 310/266

* cited by examiner

*Primary Examiner*—Michael Koczo, Jr.
(74) *Attorney, Agent, or Firm*—Greenblum & Bernstein, P.L.C.

(57) ABSTRACT

Disclosed is a scroll compressor enabling a significant height reduction to use a space of a system efficiently when the scroll compressor is applied to such systems as a refrigerator, an air conditioner, and the like. A compressor housing forms an exterior, a crankcase is fixed inside the compressor housing, a boss is formed at a central portion thereof to protrude downward, and a bearing hole is formed in a center thereof. A stator having a hollow shape is fixed to a lower side of the crankcase, and a rotor is provided to maintain a clearance between an outer circumferential surface of the stator and an inner circumferential surface thereof. A crankshaft is provided to pass through the bearing hole and is fixed to the rotor to revolve together with the rotor, wherein an eccentric pin is formed on an upper side thereof. A orbiting scroll is connected to the eccentric pin, and a fixed scroll fixed to an upper side of the crankcase to form a compression chamber together with the orbiting scroll.

20 Claims, 17 Drawing Sheets

SCROLL COMPRESSOR

RELATED APPLICATION

This application claims the benefit of the Korean Application Nos. P2002-50906, P2002-50907, P2002-50908 and P2002-50909 filed on Aug. 27, 2002, which is hereby incorporated by reference in their entireties.

BACKGROUND OF THE INVENTION

1. Field of the Invention

The present invention relates to a scroll compressor, and more particularly, to an outer rotor type scroll compressor.

2. Description of the Related Art

Generally, a scroll compressor is a device for compressing a fluid kept in a compression chamber by varying a volume of the compression chamber constructed with movable and fixed scrolls by rotating the orbiting scroll. The scroll compressor has an efficiency greater than that of a reciprocating or rotary compressor, small vibration, and low noise, and can be made light in weight. Hence, the scroll compressor is used in various fields nowadays.

Constitution and operation of a scroll compressor according to a related art are explained by referring to the attached drawings as follows.

Referring to FIG. 1A, a scroll compressor according to a related art includes a compressor housing 1, a crankcase 2, an inner rotor type motor 3, a crankshaft 4, an orbiting scroll 5, and a fixed scroll 6.

The compressor housing 1 forms an exterior of the compressor, and various components are provided in the compressor housing 1.

The crankcase 2 is fixed inside the compressor housing 1. A boss 2*a* protrudes downward from a central portion of the crankcase 2, and a bearing hole 2*b* penetrates a center of the boss 2*a*.

The inner rotor type motor 3 is provided at a lower side of the crankcase 2, and includes a rotor 3*a* and a stator 3*b*. The rotor 3*a*, as shown in FIG. 1A, is fixed to a circumference of the crankshaft 4 to revolve together with the crankshaft 4. The stator 3*b* is fixed inside the compressor housing 1. And, the rotor 3*a* is positioned in a hollow central portion of the stator 3*b* so that an inner circumferential surface of the stator 3*b* is spaced by a predetermined interval from an outer circumferential surface of the rotor 3*a*.

The crankshaft 4 is coupled with the rotor 3*a* to revolve together. One side of the crankshaft 4 is configured to penetrate the bearing hole 2*b* formed in the crankcase 2. And, an eccentric pin 4*a* is formed at an upper end of the crankshaft 4 near the crankcase 2. Further, a bearing is provided between the bearing hole 2*b* and the crankshaft 4 to guarantee smooth rotation of the crankshaft 4.

The orbiting scroll 5 is coupled with the eccentric pin of the crankshaft 4 to rotate.

The fixed scroll 6 is coupled with the crankcase 2 to be fixed thereto, and provides a compression chamber 6 with the orbiting scroll 5 to compress a fluid confined in the compression chamber 6*a*.

Meanwhile, the scroll compressor according to the related art further includes a plurality of counterweights canceling out an eccentric force generated when the orbiting scroll 5, eccentric from a rotation center, and the eccentric pin 4*a* of the crankshaft 4 are rotating. The counterweights, as shown in FIG. 1A, include an upper counterweight 7 provided in a direction opposite to an eccentric direction of the eccentric pin 4*a* of the crankshaft 4 and a lower counterweight 8 provided in the same direction of the eccentric direction of the eccentric pin 4*a* of the crankshaft 4 near a bottom of the rotor 3*a*.

Referring to FIG. 1B, the scroll compressor according to the related art can further include a sub-frame 9 as well as the above-explained elements. The sub-frame 9 is provided at a lower side of the crankshaft 4. One side of the sub-frame 9 is fixed to an inner lower side of the compressor housing 1 to support a bottom of the crankshaft 4, thereby preventing the crankshaft 4 from falling due to gravity.

Referring to FIG. 1C and FIG. 1D, the scroll compressor according to the related art has an oil supply path for smooth lubrication of rotational and frictional portions and a return structure for returning the supplied oil. And, they are explained briefly in the following.

First of all, oil 1*b* is stored in an inner lower side of the compressor housing 1.

A lower end of the crankshaft 4 is positioned to dip in the stored oil 1*b*, and an oil supplying path 4*b* is formed inside the crankshaft 4 to be inclined in a direction extending farther from the rotation center of the crankshaft 4 toward an upper side.

Moreover, an oil return path 2*c* is formed in the crankcase 2 to penetrate from a central portion to one side of the crankcase 2, and is formed for returning the oil 1*b*, which has been supplied to the center of the crankcase 2 through the oil supplying path 4*b*, to a lower side of the compressor housing 1.

Further, an oil path 1*a*, as shown in FIG. 1C and FIG. 1D, is formed between an inner face of the compressor housing 1 and an outer circumferential surface of the stator 3*b* to guide the oil 1*b* drained through the oil return path 2*c* to the lower side of the compressor housing 1.

The above-constituted scroll compressor according to the related art operates as follows.

First of all, power is applied to turn the rotor 3*a* and crankshaft 4, and then the turning crankshaft 4 revolves the orbiting scroll 5 coupled with the eccentric pin 4*a*. As the orbiting scroll 5 revolves, a fluid locked inside the compression chamber formed between the fixed and orbiting scrolls 6 and 5 becomes compressed.

Simultaneously, while the crankshaft 4 turns, the oil 1*b* in the lower side of the compressor housing 1 is elevated along the oil supplying path 4*b* by a centrifugal force to lubricate the bearing unit at a side of the crankcase 2. Most of the supplied oil 1*b* is returned to the lower side of the compressor housing 1 along the oil return path 2*c* and the oil path 1*a* to be kept in store.

However, the above-constituted scroll compressor according to the related art has the following problems or disadvantages.

First of all, the rotor 3*a* provided at the lower side of the crankcase 2 is fixed to the circumference of the crankshaft 4 and the crankshaft 4 is provided to penetrate the bearing hole 2*b* formed in the center of the boss 2*a* of the crankcase 2. Hence, the boss 2*a* of the crankcase 2 and the rotor 3*a* occupy the spaces at upper and lower sides of the crankshaft 4, thereby setting structural limitation on reducing the height of the machine.

Secondly, the upper counterweight 7 is provided in the direction opposite to the eccentric direction of the eccentric pin 4*a* of the crankshaft 4 over the rotor 3*a* to be disposed between the boss 2*a* of the crankcase 2 and the top surface of the rotor 3*a*. Hence, the height of the machine increases additionally.

Thirdly, the inner rotor type motor 3 has the rotor 3*a* located inside the stator 3*b*. And, an outer diameter of the inner rotor type motor 3 is smaller than that of an outer rotor type motor having a rotor placed outside a stator. In order to cancel out the eccentric force when one angular speed ω of the counterweight is equal to the other under the same condition, a mass m should be increased to be inversely proportional to a distance r between a rotation center and a weight center of the counterweight using the equation of '$F=mr\omega^2$' for finding a centrifugal force of the counter weight. Hence, the size, i.e. height, of the counterweight should be increased to increase the mass with the same material, whereby the height of the machine is increased more to enhance the structural limitation together with the above-explained second problem of the related art.

SUMMARY OF THE INVENTION

Accordingly, the present invention is directed to a scroll compressor that substantially obviates one or more problems due to limitations and disadvantages of the related art.

An object of the present invention is to provide a scroll compressor enabling a substantial reduction in height to use a space of a system efficiently when the scroll compressor is applied to such systems as a refrigerator, an air conditioner, and the like.

Another object of the present invention is to provide a scroll compressor enabling a reduction in product cost and simplifying an assembly process by replacing a heavy and large counterweight of the related art.

A further object of the present invention is to provide a scroll compressor enabling to a reduced product cost and a simplified assembly process by replacing a sub-frame of the related art to reduce a height of the compressor.

Another further object of the present invention is to provide a scroll compressor preventing returning oil from dispersing by a rotor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a scroll compressor according to the present invention includes a compressor housing forming an exterior housing, a crankcase fixed inside the compressor housing wherein a boss is formed at a central portion thereof to protrude downward and a bearing hole is formed in a center thereof, a stator having a hollow shape to be fixed to a lower side of the crankcase, a rotor provided to maintain a clearance between an outer circumferential surface of the stator and an inner circumferential surface thereof, a crankshaft provided to pass through the bearing hole and fixed to the rotor in part to revolve together with the rotor wherein an eccentric pin is formed on an upper side thereof, an orbiting scroll connected to the eccentric pin, and a fixed scroll fixed to an upper side of the crankcase to form a compression chamber together with the orbiting scroll.

Preferably, the boss of the crankcase is embedded in the hollow portion of the stator.

Preferably, the stator is screw-coupled with a bottom of the crankcase to be fixed thereto.

More preferably, an inner circumferential surface of the stator is fitted into an outer circumferential surface of the boss of the crankcase by force to be fixed.

Preferably, at least one balance hole is formed in the rotor.

More preferably, the balance hole comprises at least one upper balance hole formed on an upper side of a circumference of the rotor in a same direction of an eccentric direction of the eccentric pin of the crankshaft.

More preferably, the balance hole comprises at least one lower balance hole formed on a lower side of a circumference of the rotor in a direction opposite to an eccentric direction of the eccentric pin of the crankshaft.

More preferably, the rotor includes a cylindrical rotor housing having an opening at an upper side and a rotor conductor fitted in an inner circumferential surface of the rotor housing.

More preferably, at least one interconnecting hole having an oil or gas passage there through is formed in a bottom of the rotor housing.

More preferably, at least one balance hole is further formed in the rotor housing.

More preferably, the balance hole comprises at least one upper balance hole formed on an upper side of a circumference of the rotor in a same direction of an eccentric direction of the eccentric pin of the crankshaft.

More preferably, the balance hole comprises at least one lower balance hole formed on a lower side of a circumference of the rotor in a direction opposite to an eccentric direction of the eccentric pin of the crankshaft.

Preferably, the scroll compressor further includes a sub-frame provided at a lower side of the crankshaft to support a lower end of the crankshaft.

Preferably, the scroll compressor further includes a thrust face formed on an upper side of the bearing hole of the crankcase to have a step difference and a thrust portion protruding from a circumference of the crankshaft wherein a lower face of the thrust portion is supported by the thrust face.

More preferably, the thrust portion protrudes along the circumference of the crankshaft on a boundary of a lower face of the eccentric pin of the crankshaft.

Preferably, the scroll compressor further includes an oil supplying path passing through the crankshaft in an upper/lower direction, an oil return path passing through the crankcase from one side of center to an outside, and an oil guide member guiding oil from the oil return path to a lower side of the rotor.

More preferably, the oil guide member is a channel type guide plate having an opening formed along a length direction of one side toward an inner wall of the compressor housing.

More preferably, an upper side of the guide plate gradually extends toward an edge of the guide plate.

More preferably, the oil guide member is a guide pipe having one end connected to the oil return path and the other end disposed in a space of the lower side of the rotor.

More preferably, the guide pipe is provided outside the compressor housing in part.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1A:
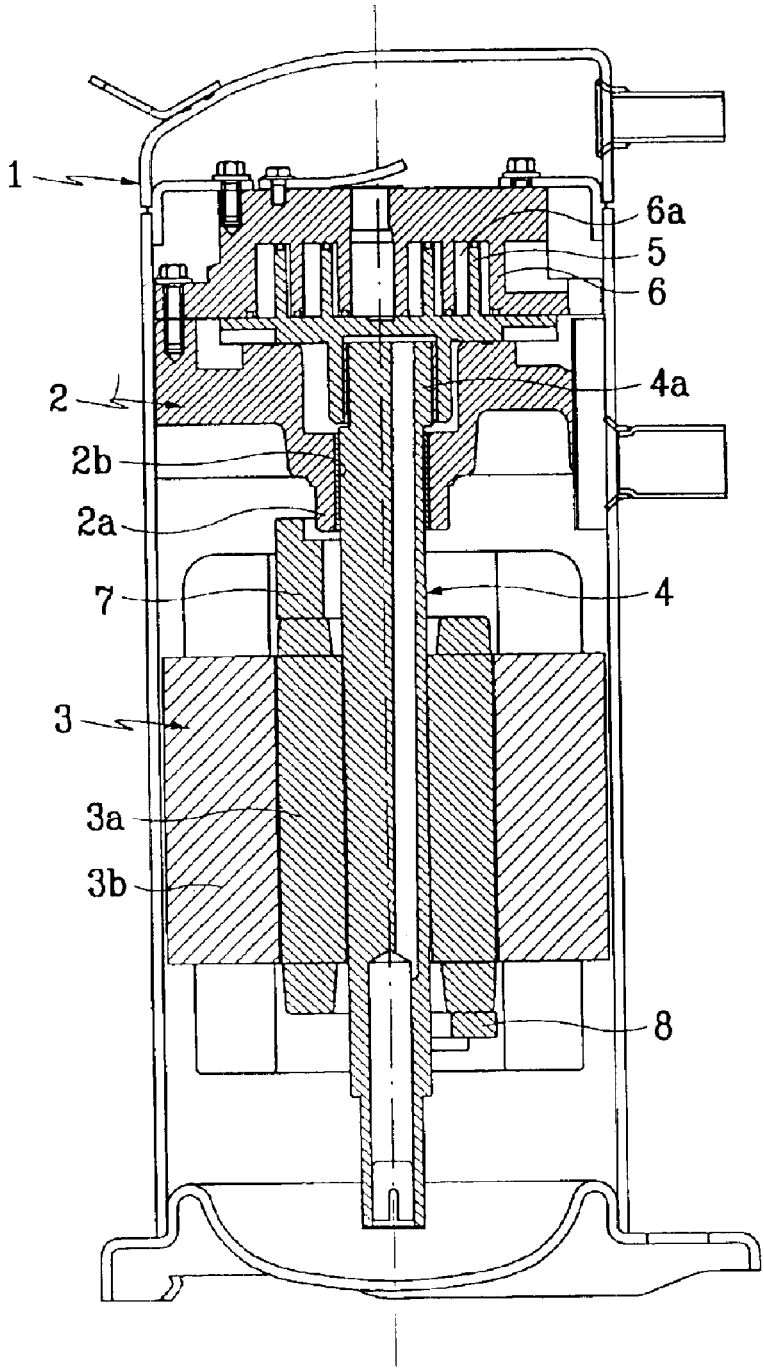
FIG.1A Prior Art
FIG. 1A and FIG. 1B illustrate cross-sectional views of an inner rotor type scroll compressor according to a related art.
Figure 1B:
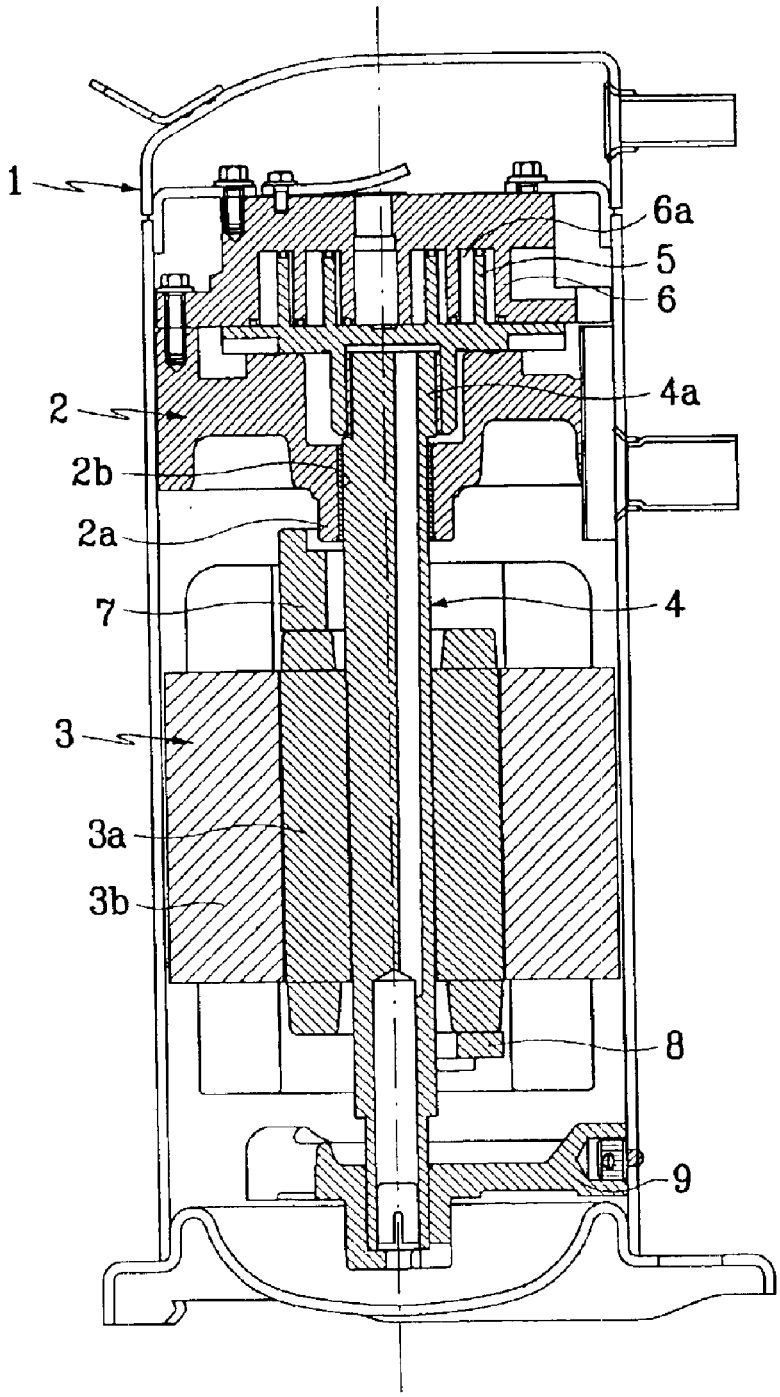
FIG.1B Prior Art
Figure 1C:
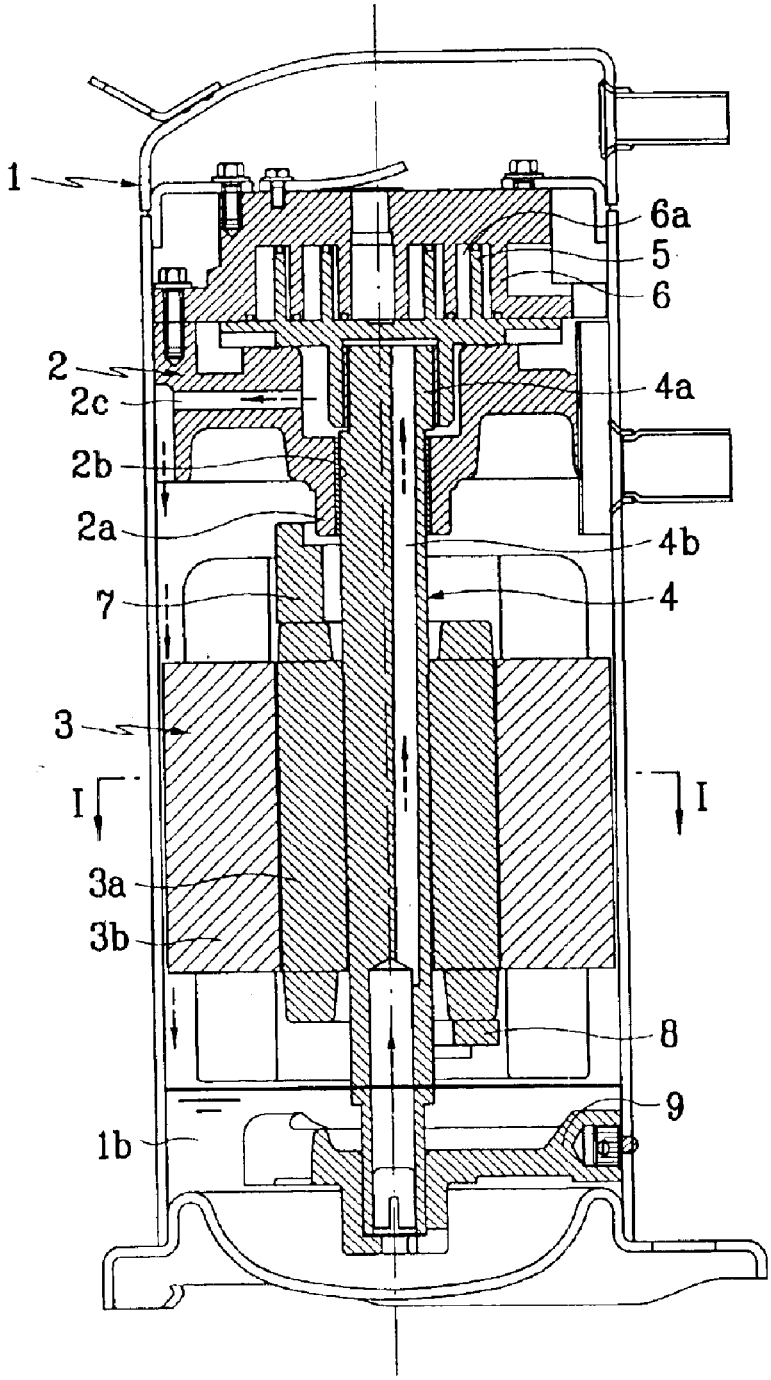
FIG.1C Prior Art
FIG. 1C illustrates a cross-sectional view for showing a flow of a lubrication oil in FIG. 1B.
Figure 1D:
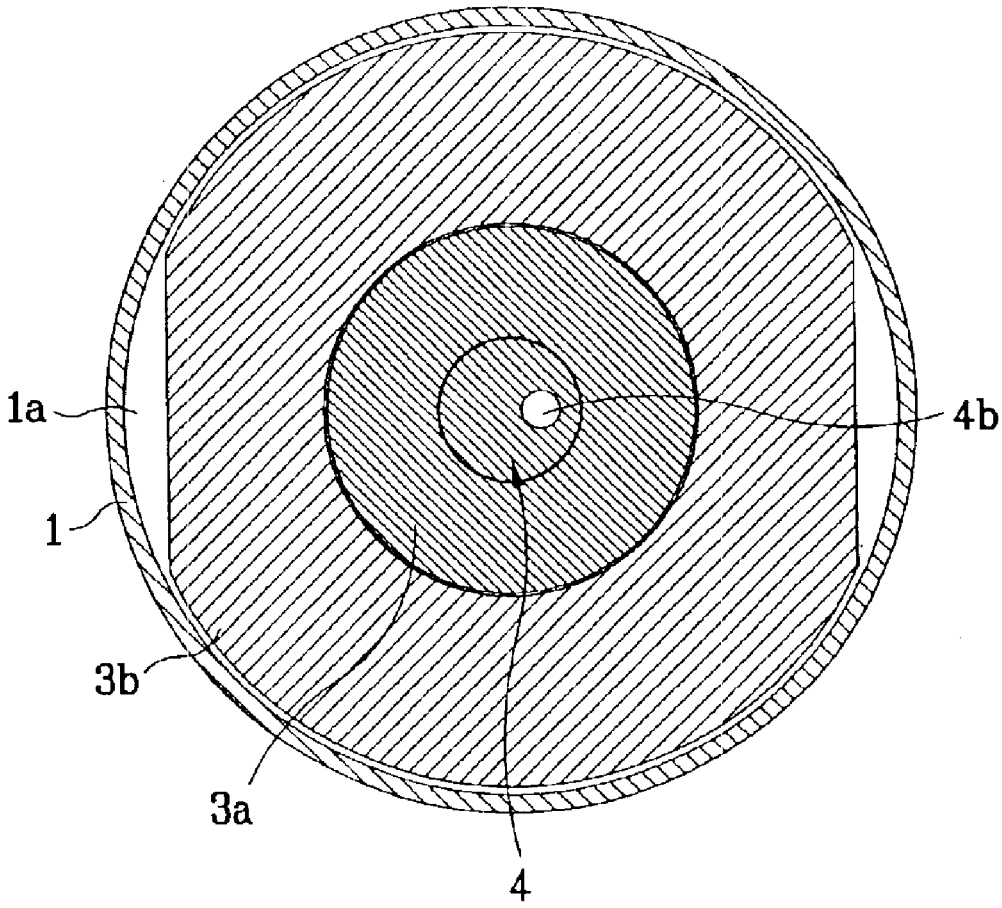
FIG.1D Prior Art
FIG. 1D illustrates a cross-sectional view along a cutting line I—I in FIG. 1C.
Figure 2A:
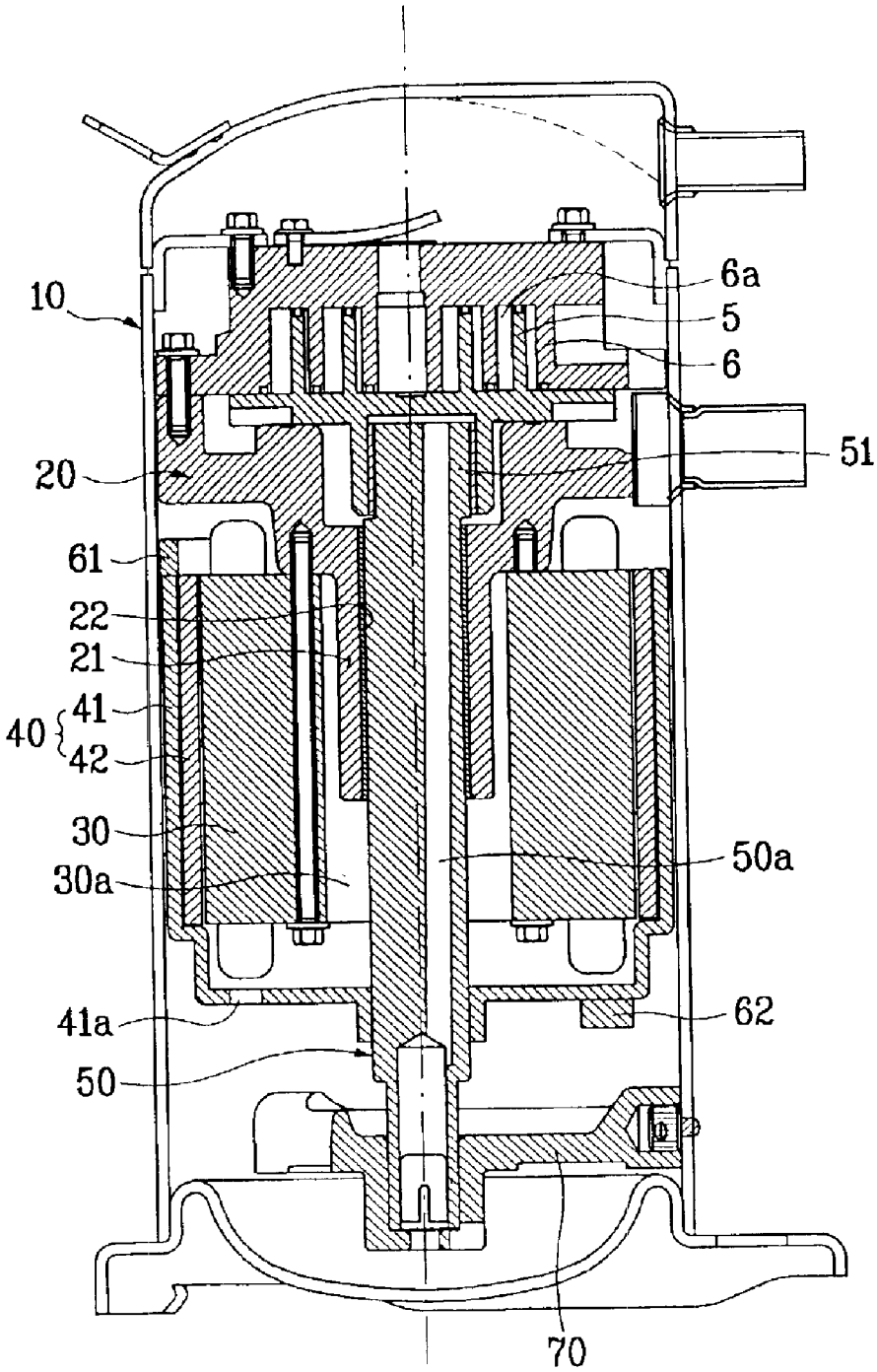
FIG. 2A illustrates a cross-sectional view of a scroll compressor according to one embodiment of the present invention.

FIG. 2A illustrates a cross-sectional view of a scroll compressor according to one embodiment of the present invention.

Referring to FIG. 2A, a compressor housing forms an exterior housing and various elements are provided inside the compressor housing 10.

A crankcase 20 is fixed inside the compressor housing 10, and a boss 21 protrudes downward from a central portion of the crankcase 20. And, a bearing hole 22 penetrates through a central portion of the boss 21 upward and downward.

Unlike the related art, the present invention uses an outer rotor type motor, as shown in FIG. 2A, to turn a crankshaft 50. The outer rotor type motor used by the present invention includes a stator 30 and a rotor 40, and specific constitution and operation of the outer rotor type motor are explained as follows.

Figure 2B:
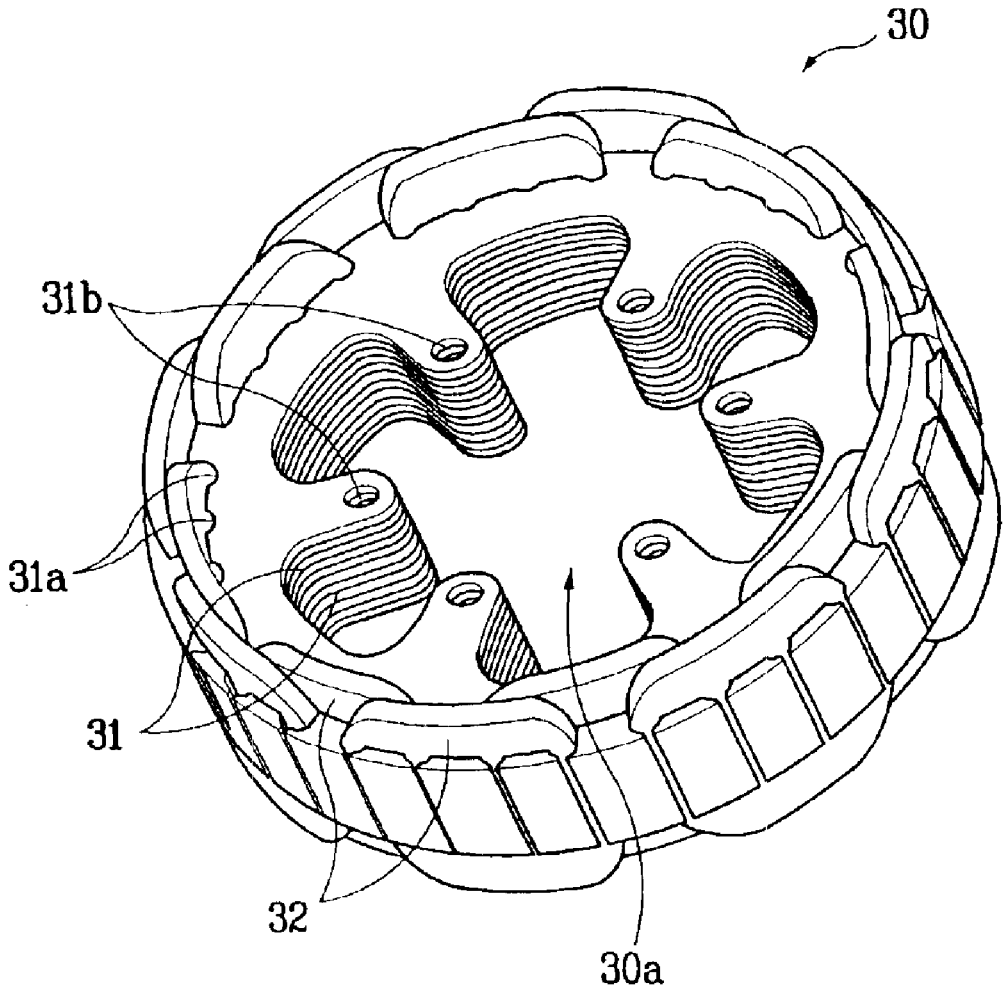
FIG. 2B illustrates a bird's-eye view of a stator according to the present invention.

First of all, the stator 30, as shown in FIG. 2B, is constructed with a plurality of electrical steel plates 31 having empty central parts to form a hollow shape. In this case, each of the electrical steel plates 31 includes a hollow portion 30*a* at its central part, a plurality of radial slots 31*a* at its outer circumferential surface, and a plurality of screw coupling holes 31*b* at its inner circumferential surface to fix the stator 30 to a bottom of the crankcase 20. And, the slots 31*a* and screw coupling holes 31*b* of the electrical steel plates 31 are stacked on each other to be aligned reciprocally. And, a coil 32 is wound on the slots 31*a* to complete the stator 30. The above-constituted stator 30 is fixed to the bottom of the crankcase 20.

And, the rotor 40, as shown in FIG. 2A, includes a rotor housing 41 and rotor conductor 42. The rotor housing 41, as shown in FIG. 3B and FIG. 3C, has a cylindrical shape constructed with a circumferential portion and a bottom portion, and an upper side of the rotor housing 41 is open. And, the rotor conductor 42 includes a plurality of hollow electrical steel plates (not shown in the drawing) stacked on each other, and is pushed inside an inner circumferential surface of the rotor housing 41. The above-constituted rotor 40, as shown in FIG. 2A, has its inner circumferential surface separated from an outer circumferential surface of the stator 30, and is provided inside the stator 30 to maintain a clearance therebetween.

Meanwhile, the crankshaft 50, as shown in FIG. 2A, is provided to pass through the bearing hole 22 and the hollow portion 30*a* of the stator 30, and an eccentric pin 51 with a predetermined eccentricity is formed at an upper portion of the crankshaft 50 over the bearing hole 22. And, one side of the crankshaft 50 is fixed to one side of the rotor 40, for example a bottom of the rotor housing 41. The above-constituted crankshaft 50 revolves together with the rotor 40, and a bearing is provided between the crankshaft 50 and bearing hole 21 for smooth revolution.

A orbiting scroll 5, as shown in FIG. 2A, is coupled with the eccentric pin 51 of the crankshaft 50 to carry out a turning movement when the crankshaft 50 revolves.

And, a fixed scroll 6 is fixed to an upper portion of the crankcase 20, and forms a compression chamber 6*a* together with the orbiting scroll 5 to compress a fluid confined in the compression chamber 6*a* when the orbiting scroll 5 carries out the turning movement.

In order to reduce a height of the above-constituted scroll compressor according to the present invention, the boss 21 of the crankcase 20, as shown in FIG. 2A, is positioned in the hollow portion 30*a* of the stator 30.

In this case, the stator 30, as shown in FIG. 2A, can be fixed to the bottom of the crankcase 20 by screw coupling.

Figure 2C:
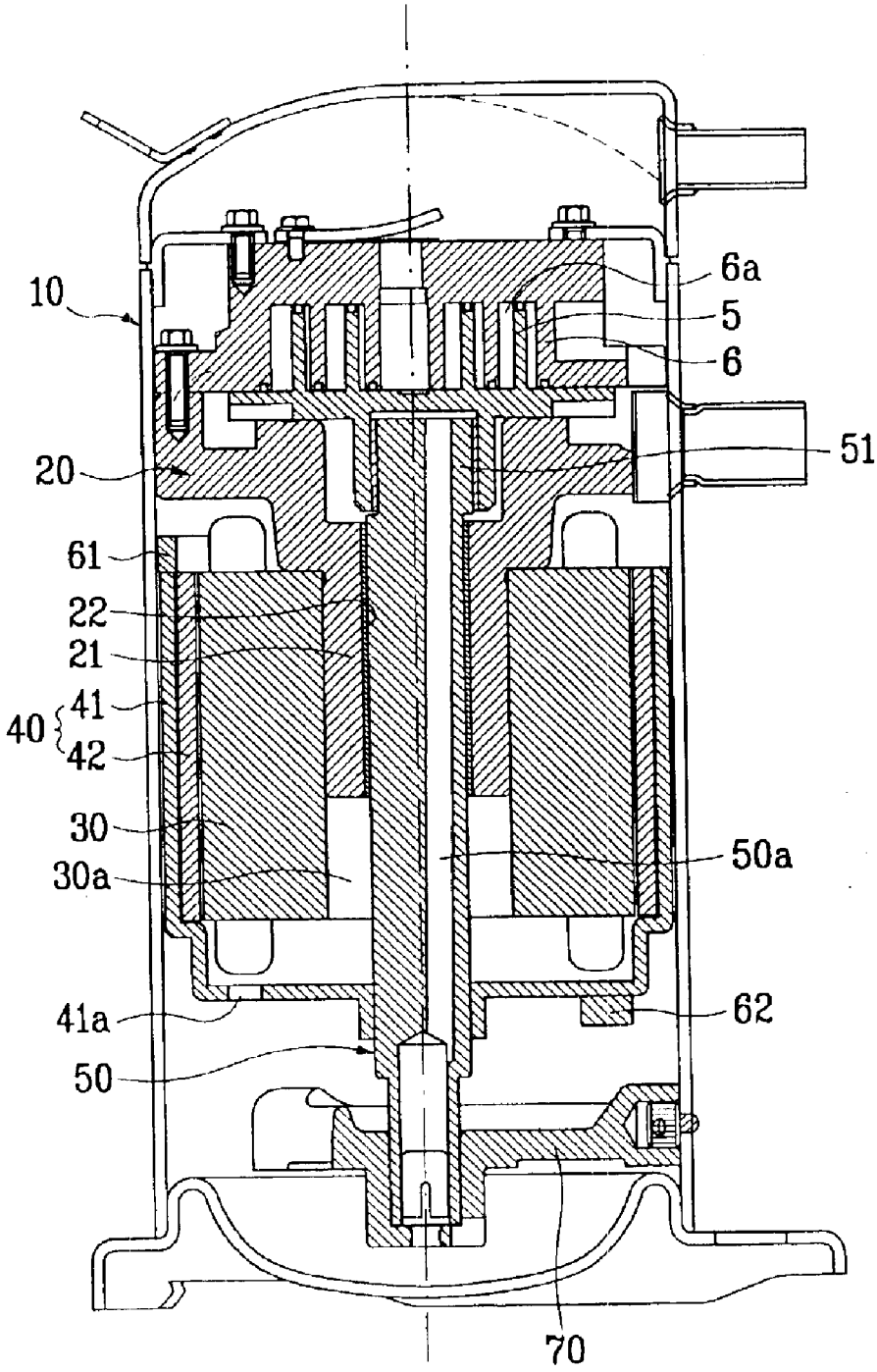
FIG. 2C illustrates a cross-sectional view that shows another example of a crankcase and a stator coupled with each other according to the present invention.

Moreover, the present invention enables fixing the stator 30 and the boss 21 of the crankcase 20 to each other in another way. For instance, an inner circumferential surface of the stator 30, as shown in FIG. 2C, can be inserted inside an outer circumferential surface of the boss 21 of the crankcase 20 to be fixed thereto directly. And, such insertion is carried out by thermal driving or cold driving. Further, in order to reinforce the fixing force and support the crankshaft 50 safely after the boss 21 and stator 30 have been fitted to each other, a length of the boss 21 can be increased.

Meanwhile, the scroll compressor according to the present invention can further include an eccentric force canceling means for canceling out or balancing an eccentric force generated from the turning movement of the orbiting scroll 5.

For instance, a counterweight is a good example of the eccentric force canceling means. And, at least one counterweight is provided at one side of the rotor 40, for example the rotor housing 41.

Such counterweights include upper and lower counterweights 61 and 62.

The upper counterweight 61 is provided on an upper side of the rotor 40 disposed in a direction opposite to an eccentric direction of the eccentric pin 51 of the crankshaft 50, as shown in FIG. 2A and FIG. 2C, for example an upper side of the rotor housing 41 disposed in the direction opposite to the eccentric direction of the eccentric pin 51 of the crankshaft 50.

And, the lower counterweight 62 is provided on a lower side of the rotor 40 disposed in the same direction of the eccentric direction of the eccentric pin 51 of the crankshaft 50, as shown in FIG. 2A and FIG. 2C, for example a lower side of the rotor housing 41 disposed in the same direction of the eccentric direction of the eccentric pin 51 of the crankshaft 50.

Figure 2D:
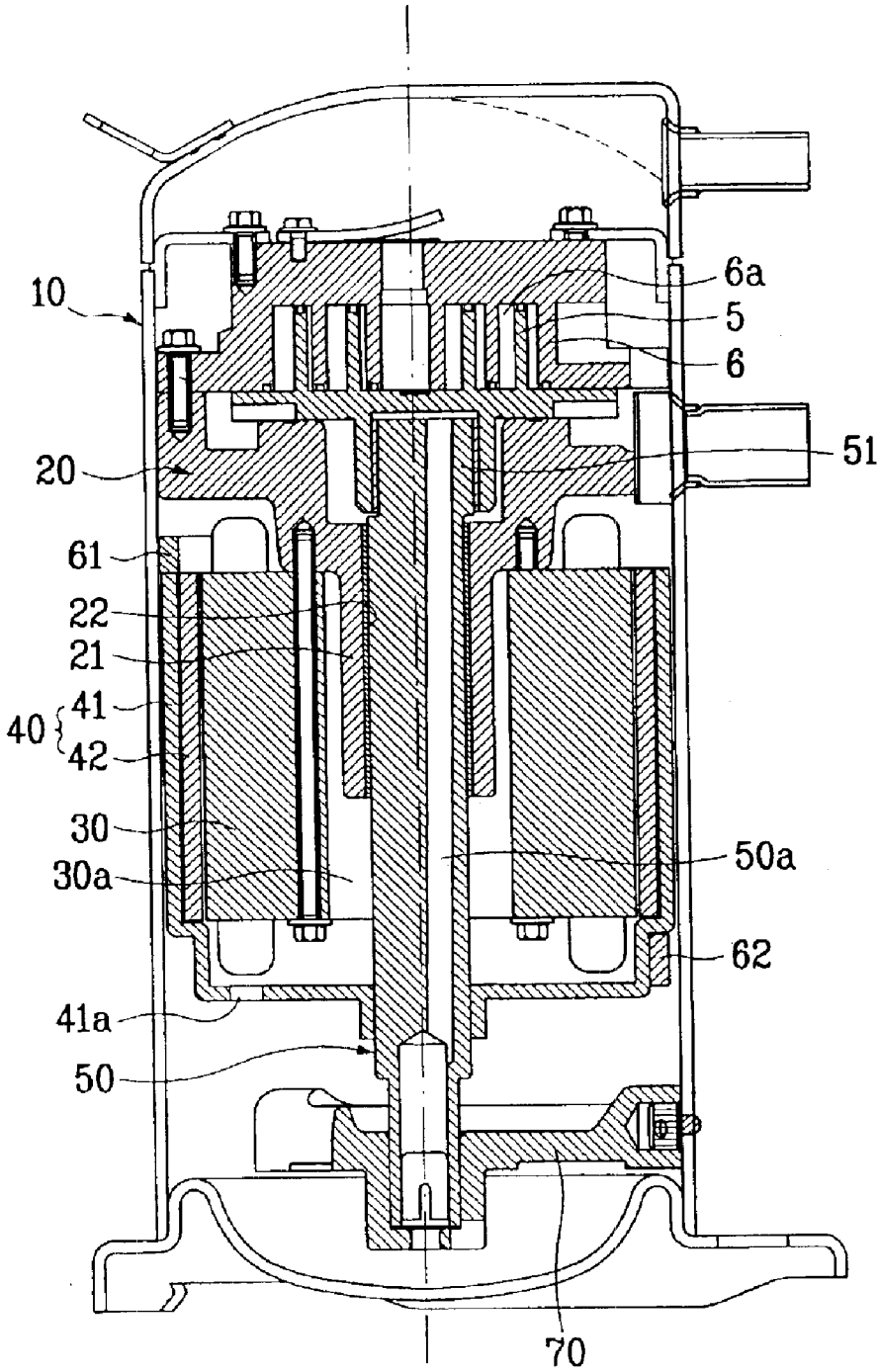
FIG. 2D illustrates a cross-sectional view of a lower counter weight according to another embodiment of the present invention.

In this case, the lower counterweight 62 is provided at a lower face of the rotor 40, as shown in FIG. 2A and FIG. 2C, for example a lower face of the bottom of the rotor housing 41, or a lower part of a circumference of the rotor 40, for example a lower part, as shown in FIG. 2D, of a circumference of the rotor housing 41.

The above-constituted upper and lower counterweights 61 and 61 are attached to one side of the rotor 40, for example the rotor housing 41 or are configured as extensions of one body.

Moreover, the present invention can include another eccentric force canceling means.

For instance, a balance hole is a good example of another eccentric force canceling means. At least one balance hole is provided at one side of the rotor 40, for example the rotor housing 41 to cancel out the eccentric force generated from the revolution of the crankshaft 50.

Such balance holes include upper and lower balance holes 41*b* and 41*c*.

Figure 3A:
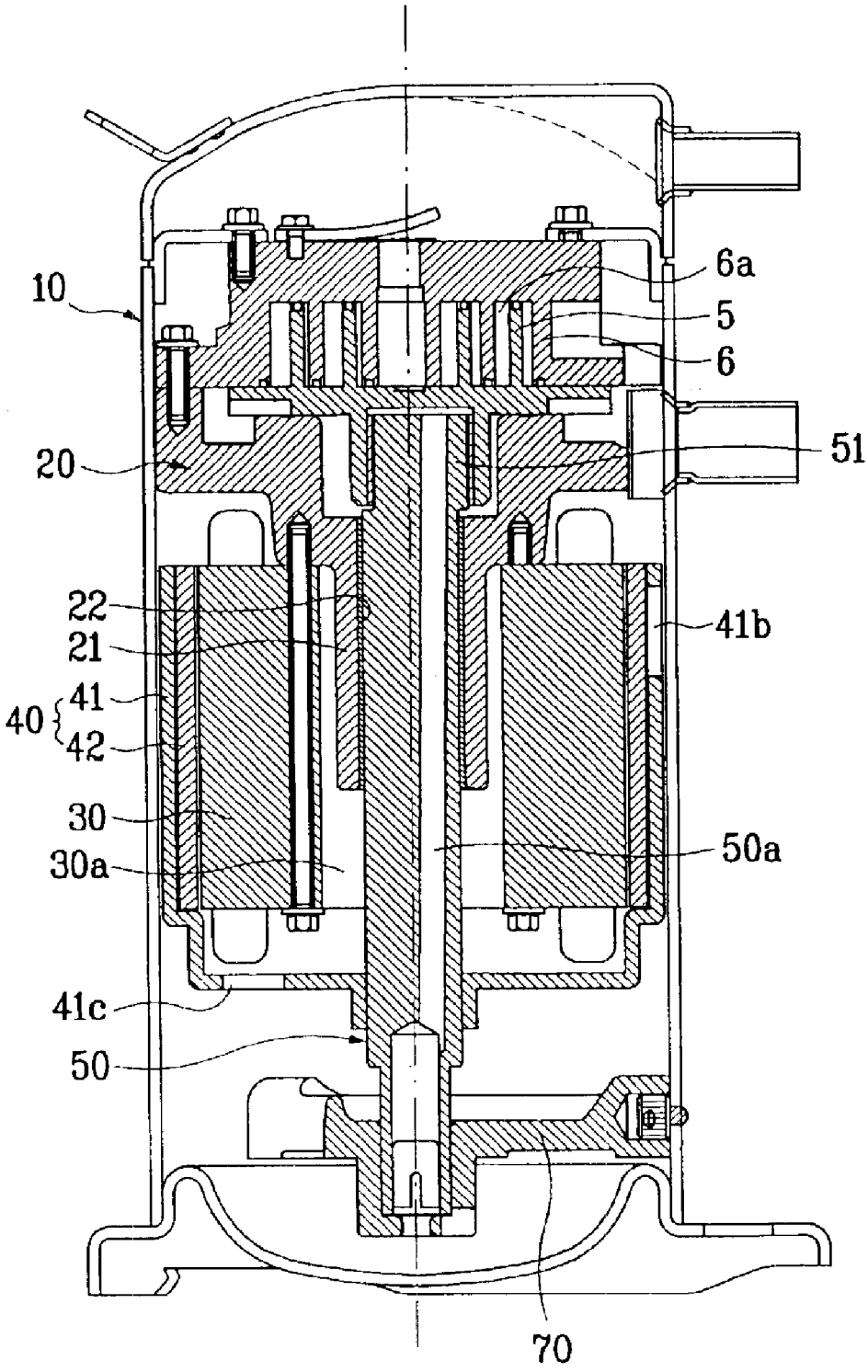
FIG. 3A illustrates a cross-sectional view of an eccentric force canceling means according to another embodiment of the present invention.
Figure 3B:
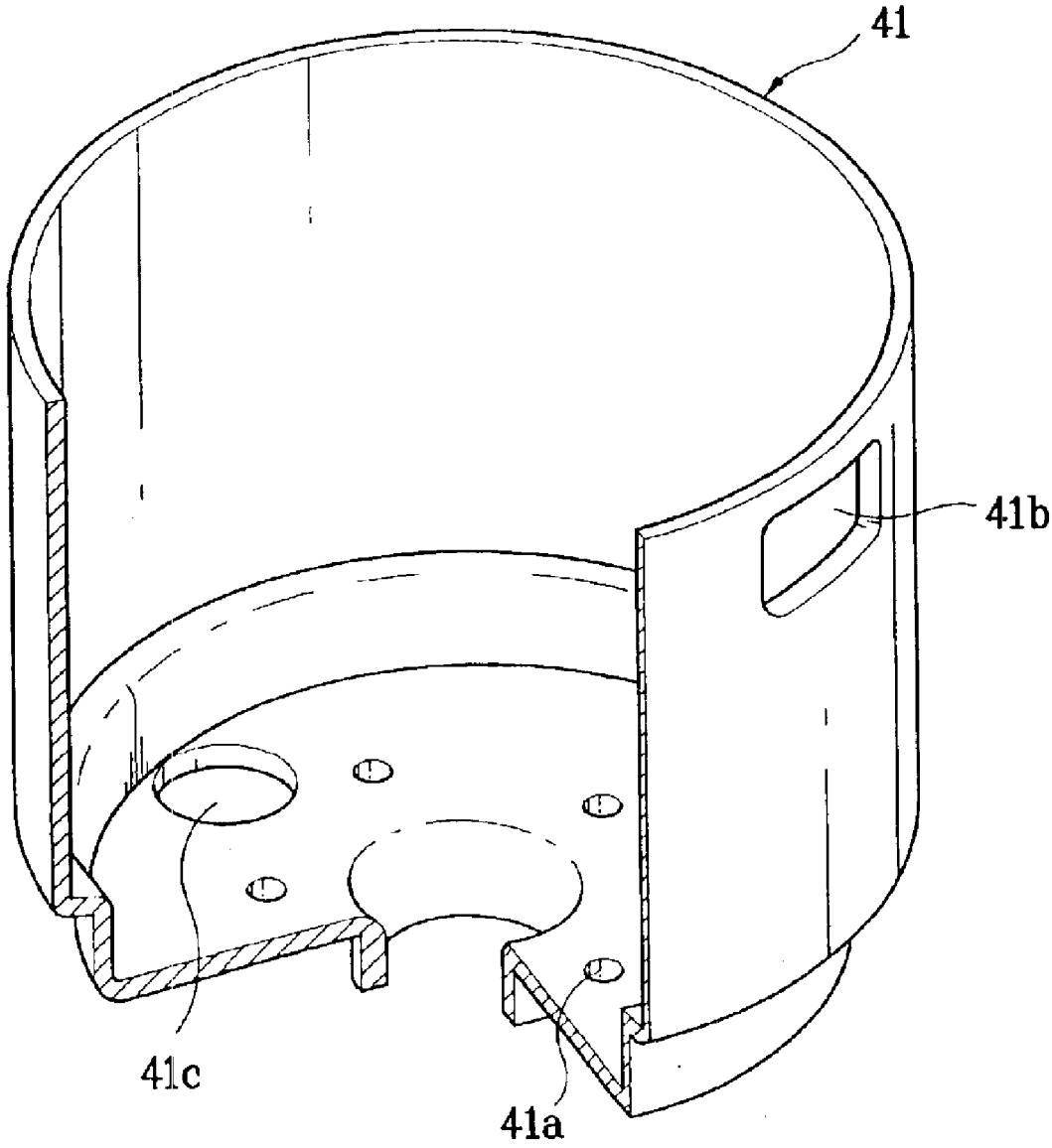
FIG. 3B and FIG. 3C illustrate bird's-eye views of rotor housings in FIG. 3A, respectively.
Figure 3C:
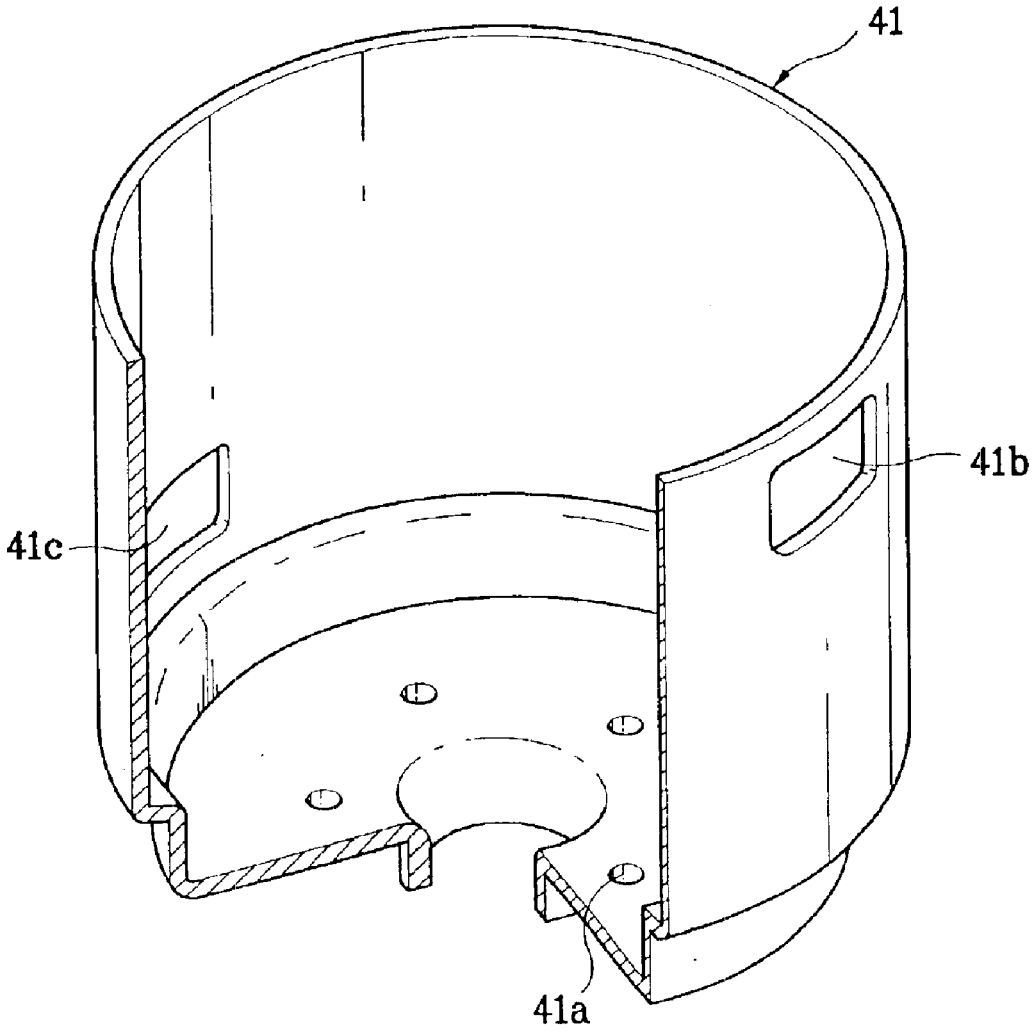

The upper balance hole 41*b* is formed on an upper side of the rotor 40 disposed in the same direction of the eccentric direction of the eccentric pin 51 of the crankshaft 50, as shown in FIGS. 3A to 3C, for example an upper side of the rotor housing 41 disposed in the same direction of the eccentric direction of the eccentric pin 51 of the crankshaft 50.

And, the lower balance hole 41*c* is formed on a lower side of the rotor 40 disposed in a direction opposite to the eccentric direction of the eccentric pin 51 of the crankshaft 50, as shown in FIG. 3B and FIG. 3C, for example a lower side of the rotor housing 41 disposed in the direction opposite to the eccentric direction of the eccentric pin 51 of the crankshaft 50.

In this case, the lower balance hole 41*c* is provided at a lower face of the rotor 40, as shown in FIG. 3A and FIG. 3B, for example a lower face of the bottom of the rotor housing 41, or a lower part of a circumferential surface of the rotor 40, for example a lower part, as shown in FIG. 3C, of a circumference of the rotor housing 41.

Each of the counterweights increases a mass of one side of the rotor 40 to cancel out the eccentric force generated from the revolution of the crankshaft 50, while each of the balance holes decreases the mass of one side of the rotor 40 to cancel out the eccentric force generated from the revolution of the crankshaft 50. Hence, the balance holes and counter weights are disposed oppositely when they are formed.

Meanwhile, the scroll compressor according to the present invention can further includes a crankshaft support for supporting the crankshaft to prevent the crankshaft 50 from drooping downward or falling due to gravity.

There is a sub-frame 70, as shown in FIG. 2A, as an example of the crankshaft support. The sub-frame 70 is provided at a lower side of the crankshaft 50. One side of the sub-frame 70 is fixed to an inner side of the compressor housing 10 to have the other side of the sub-frame 70 support a lower end of the crankshaft 50. Besides, it is obvious to apply a device for guaranteeing smooth revolution to a contact area between the lower end of the crankshaft 50 and the sub-frame 70 such as a bearing and the like. Hence, explanation for such a device is skipped in this description.

Moreover, the crankshaft support means of the present invention can be implemented differently. Other examples are shown in FIG. 4A and FIG. 4B, and are explained in the following.

Figure 4A:
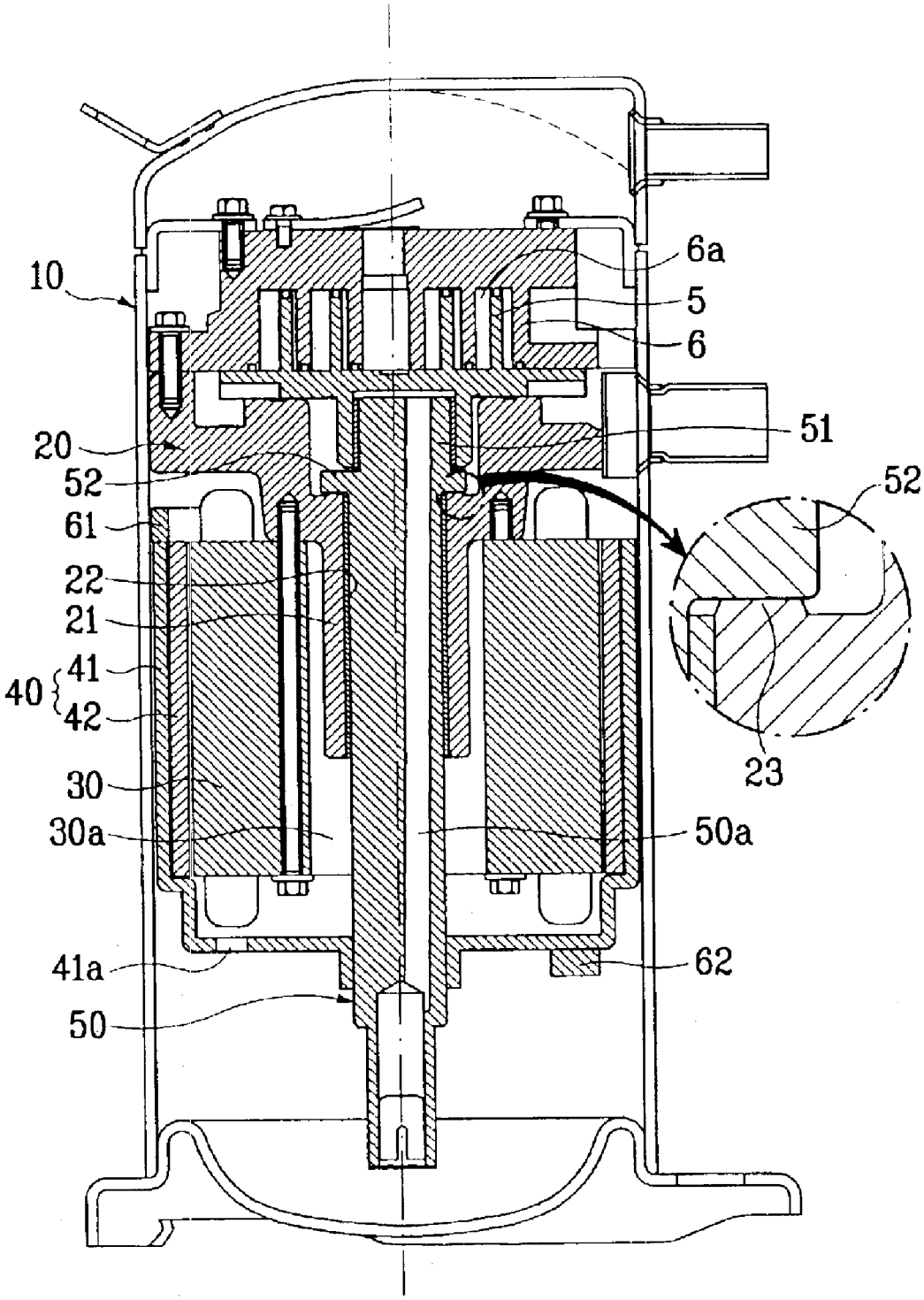
FIG. 4A illustrates a cross-sectional view of a crankshaft supporting means according to another embodiment of the present invention.
Figure 4B:
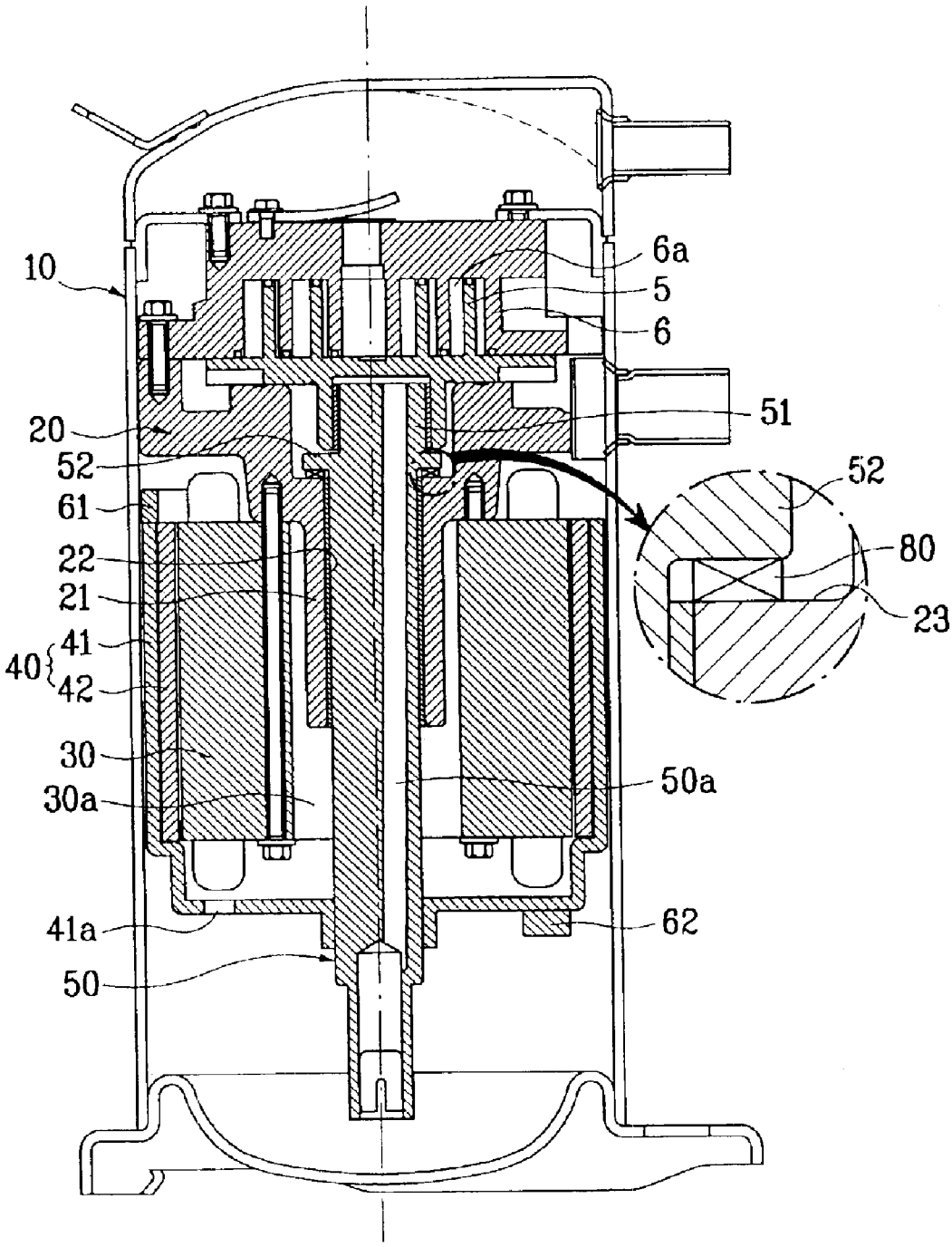
FIG. 4B illustrates a cross-sectional view of a modifying example of FIG. 4A.

Referring to FIG. 4A and FIG. 4B, the crankshaft support includes a thrust face or surface 23 formed on the crankcase 20 and a thrust portion 52 formed on the crankshaft 50. The thrust face 23 has a step difference from an upper side of the bearing hole 22 of the crankcase 20, and the thrust portion 52 protrudes from a circumference of the crankshaft 50 so that a bottom of the thrust portion 52 is contacted with the thrust face 23 to be supported. And, the thrust portion 52 protrudes along the circumference of the crankshaft 50 on a boundary of the lower face of the eccentric pin 51 of the crankshaft 50.

The thrust face 23 and thrust portion 52 play a role in maintaining a sliding contact on revolution of the crankshaft 50. Hence, the friction at the contact area should be minimized. For this, the present invention constructs the thrust face and portion 23 and 52 with an oil-less bearing, as shown in FIG. 4A, or an additional thrust bearing 80, as shown in FIG. 4B, provided between the thrust face and portion 23 and 52.

Meanwhile, the scroll compressor according to the present invention further includes a structure of oil supply and return to lubricate the revolving and frictionally contacting, which is explained by referring to FIGS. 5A to 5D as follows.

First of all, oil 11 is stored in an inner lower side of the compressor housing 10.

A lower end of the crankshaft 50 is provided to be dipped in the stored oil or oil reservoir 11, and an oil supplying path 50*a* is formed inside the crankshaft 50 to pass through a lower most end of the crankshaft 50 and a upper most end of the crankshaft 50, i.e. an upper end of the eccentric pin 51 in upper/lower direction. In this case, the oil supplying path 50*a* is formed to pass through the crankshaft 50 so that a lower end is located at a revolution center of the crankshaft 50 and an upper end is located at a position remote from the revolution center of the crankshaft 50. If the oil supplying path 50 is formed inclined, the oil 11 flowing in the lower end of the oil supplying path 50*a* is elevated to the upper end by a centrifugal force to be drained.

Moreover, an oil return path 20*a* is formed in the crankcase 20 to extend from a central portion to one side of the frame 20, and is formed for guiding the remaining oil 11, which has been supplied to the upper side of the crankcase 20 through the oil supplying path 50*a* for the lubrication of the bearing unit, to an inner wall of the compressor housing 10.

Figure 5A:
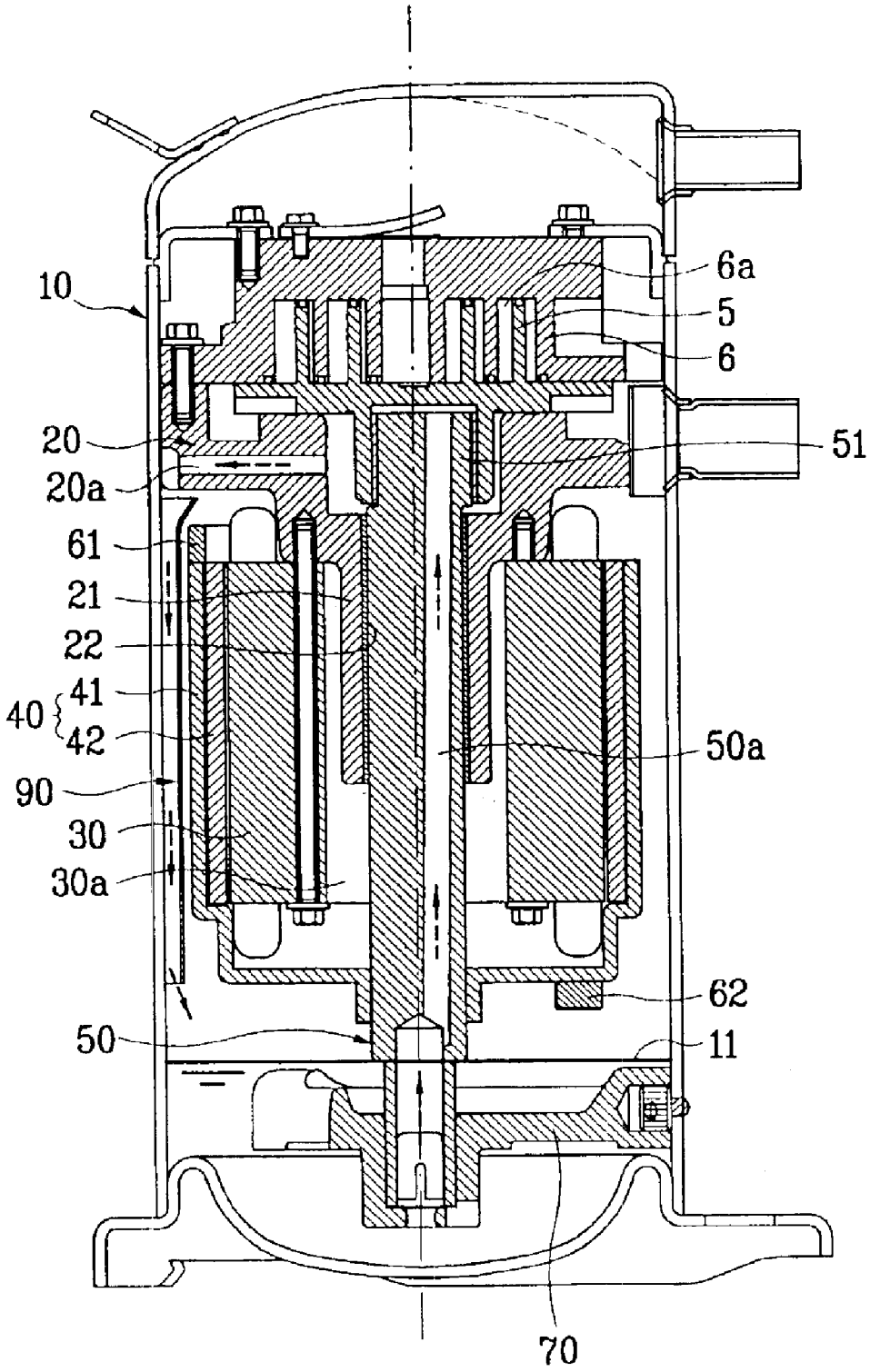
FIG. 5A illustrates a cross-sectional view of a lubrication oil circulation structure according to one embodiment of the present invention.
Figure 5B:
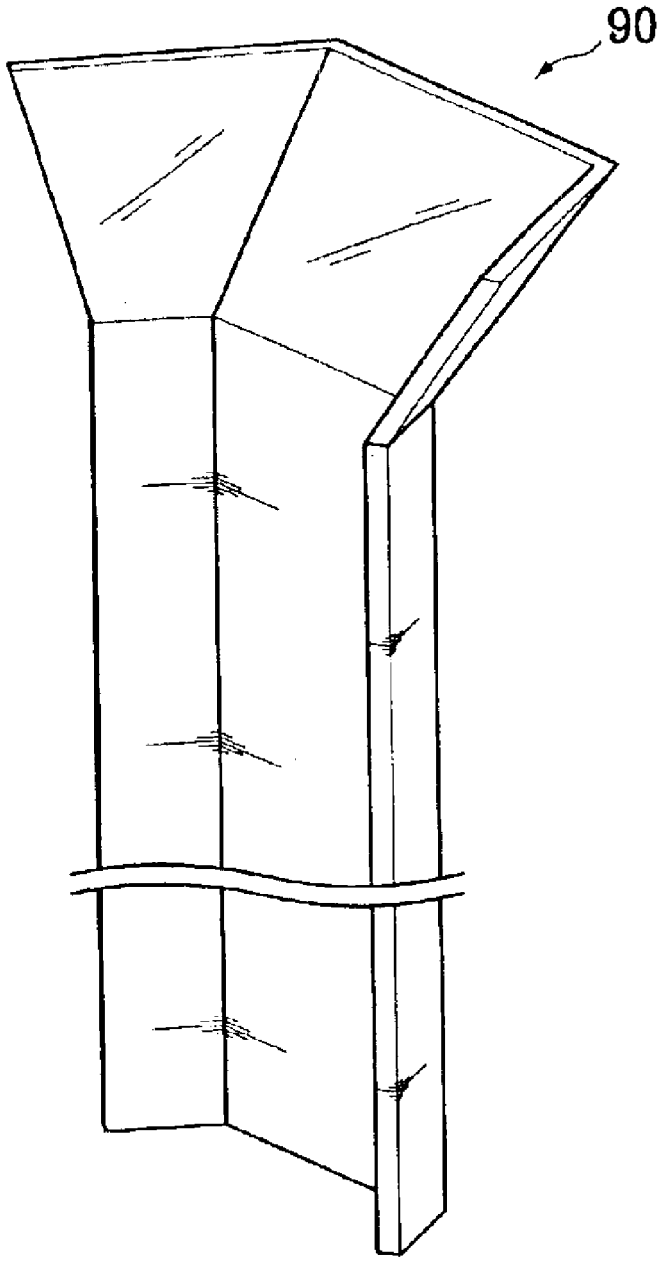
FIG. 5B illustrates a bird's-eye view of a guide plate in FIG. 5A.
Figure 5C:
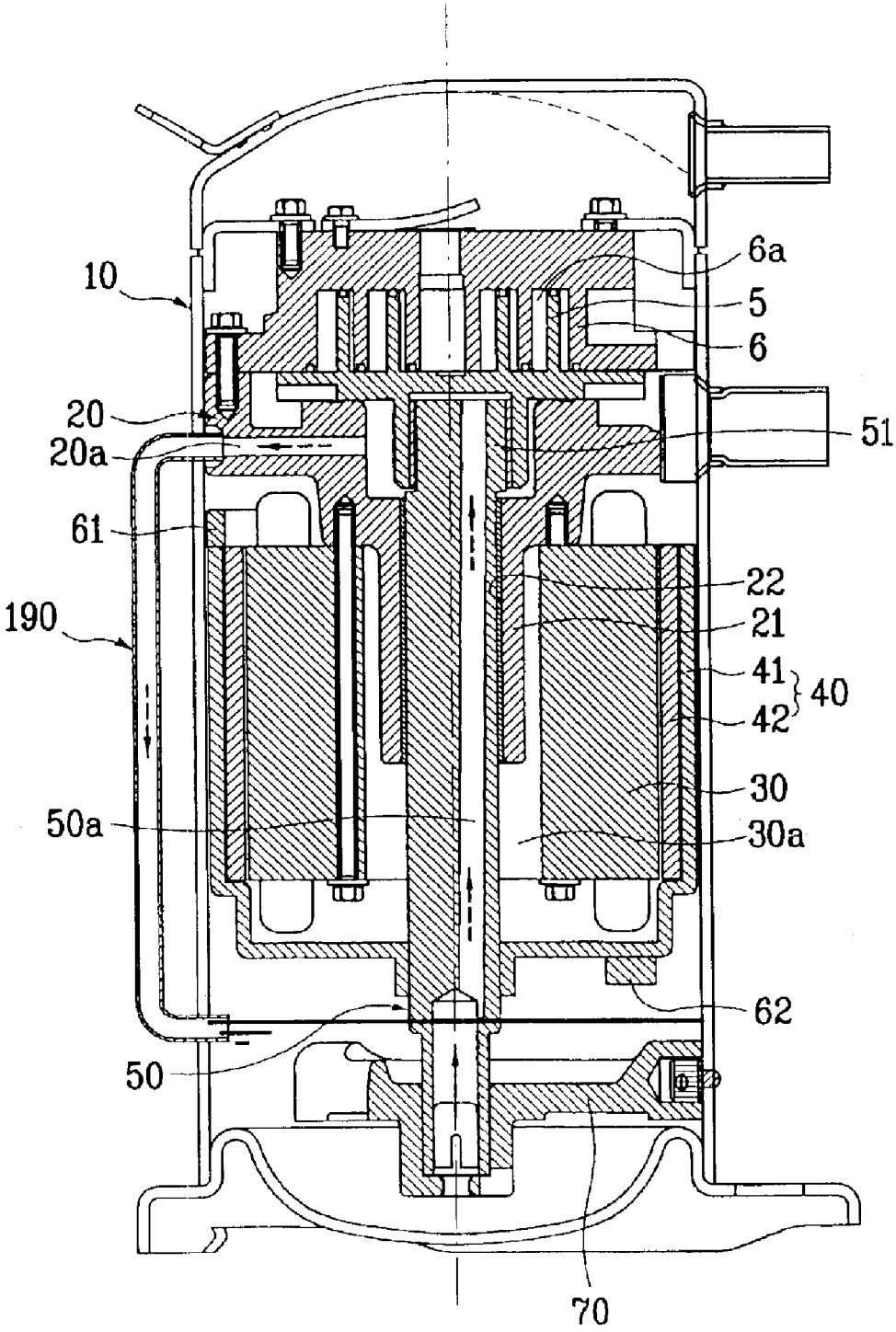
FIG. 5C and FIG. 5D illustrate cross-sectional views of oil guiding members according to another embodiments of the present invention, respectively.
Figure 5D:
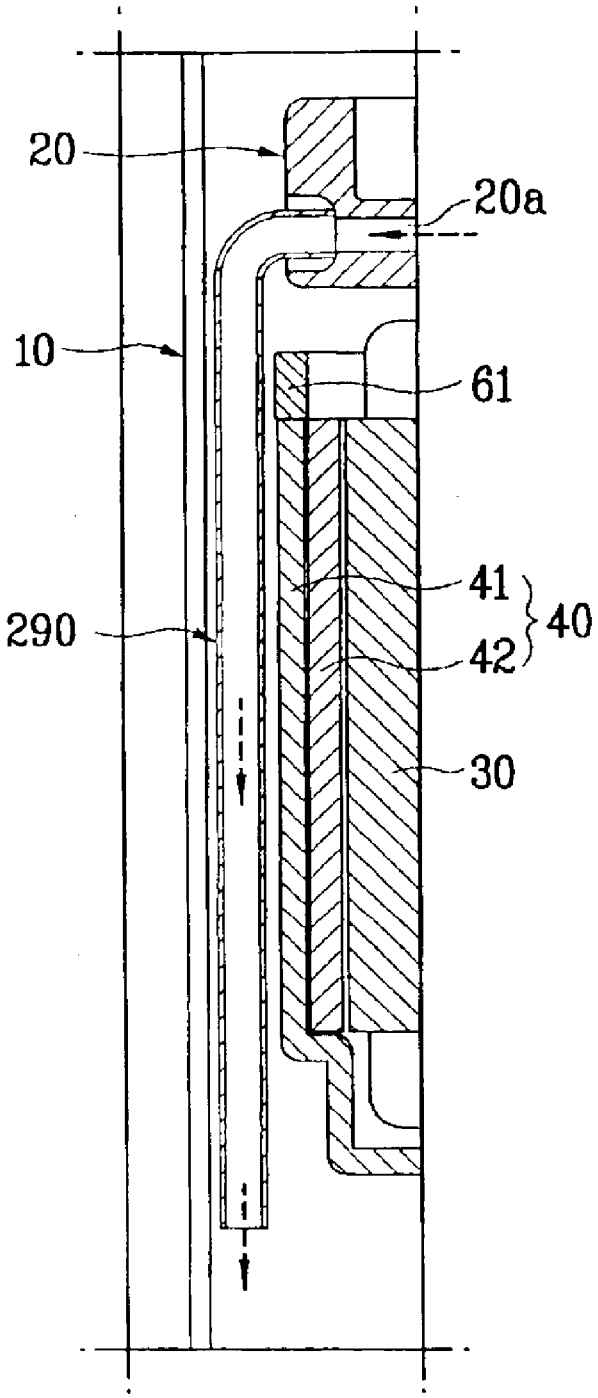

In order to prevent the oil, which has been guided by the oil return path 20*a* and drained to the inner wall of the compressor housing 10, from being dispersed by the revolving rotor 40 and guide the oil to a lower side of the rotor 40, i.e. an inner lower side of the compressor housing 10, as shown in FIG. 5C and FIG. 5D, the present invention further includes an oil guide member 90, 190, and 290. The present invention needs the oil guide member for the following reasons.

First of all, different from the scroll compressor according to the related art using the inner rotor type motor having the rotor placed at the inner circumferential surface of the stator, the scroll compressor according to the present invention uses the outer rotor type motor having the rotor 40 placed at the outer circumferential surface of the stator 30, whereby the rotor housing 41 occupies all the space between the central part and inner circumferential surface of the compressor housing 10 to revolve. If the present invention has the oil return structure of the related art, the oil dropping on the lower side of the compressor housing 10 is dispersed by the rotor 40 after being drained from the oil return path 20*a*. Besides, the dispersed oil flows inside the compression chamber 6*a* together with a gas such as refrigerant and the like. Hence, the oil as an incompressible fluid unnecessary for compression is compressed to increase a pressure of the scroll compressor, reduce a volume efficiency by the oil flowing in the compressor room, and increase an impelling loss of the rotor 40. In the worst case, the oil fails to be returned properly to cause lack of oil. Therefore, the present invention using the outer rotor type motor requires the additional oil guide members for preventing the problems from occurring.

The oil guide member can be implanted in various ways, and some examples are explained by referring to the attached drawings as follows.

Referring to FIG. 5A and FIG. 5B, the oil guide member includes a guide plate 90. The guide plate 90 has a channel shape having an opening along a length direction of one side, and is provided between the compressor housing 10 and rotor 40 so that the opening is arranged to face the inner wall of the compressor housing 10. And, in order to guide the entire oil drained through the oil return path 20*a*, an upper portion of the guide plate 90, as shown in FIG. 5B, has a funnel shape extending in area toward the edge of the upper portion.

Referring to FIG. 5C and FIG. 5D, the oil guide member includes a guide pipe. One end of the guide pipe is connected to the oil return path 20*a* and the other end is disposed in a lower side space of the rotor 40, i.e. an inner lower side space of the compressor housing 10. The above-provided guide pipe, as shown in FIG. 5C, can have an external guide pipe 190 exposed in part outside the compressor housing 10, or an internal guide pipe 290, as shown in FIG. 5D, embedded entirely inside the compressor housing 10.

Moreover, the present invention includes at least one interconnecting hole 41*a*, through which an oil or gas can pass, as shown in FIG. 2A or FIG. 3B, formed in the bottom of the rotor housing 41. And, a plurality of the interconnecting holes 41*a* are preferably formed along a circumferential direction of the bottom of the rotor housing 41.

The interconnecting holes 41*a* of the present invention are formed in the bottom of the rotor housing because of the following reason.

First of all, once the scroll compressor starts to operate, the oil 11 stored in the lower side of the compressor housing 10 is elevated to the upper side of the crankcase 20 along the oil supplying path 50*a* formed inside the crankshaft 50, lubricates the bearing unit at the side of the crankcase 20, and falls downward, in this order. In this case, if there is no interconnecting hole 41*a*, the oil having lubricated the bearing unit gathers on the bottom of the rotor housing 41. Hence, the present invention forms the interconnecting hole 41*a* in the bottom of the rotor housing 41 to move the oil smoothly to the lower side of the compressor housing 10 as well as make the gas flow in and out smoothly.

Operation of the above-constituted scroll compressor according to the present invention is similar to that of the related art, and is explained as follows.

First of all, a power is applied to turn the rotor 40 and crankshaft 50, and then the turning crankshaft 50 revolves the orbiting scroll 5 coupled with the eccentric pin 51. When turning, the crankshaft 50 is supported stably by the crankshaft support with the cancellation of the eccentric force by the eccentric force cancellation device. As the orbiting scroll 5 carries out the turning movement, the fluid confined inside the compression chamber between the fixed and orbiting scrolls 6 and 5 becomes compressed.

Simultaneously, while the crankshaft 50 turns, the oil 11 in the lower side of the compressor housing 10 is elevated along the oil supplying path 50*a* by the centrifugal force to lubricate the bearing unit at a side of the crankcase 20. Most of the elevated oil 11 is returned to the lower side of the compressor housing 10 along the oil return path 20*a* and oil guide member to be stored. Moreover, some of the oil 11 falls on the lower side after lubricating the bearing unit, and then is returned to the lower side of the compressor housing 10 through the interconnecting hole 41*a* of the rotor housing 41 to be stored.

Therefore, the above-constituted and -operating scroll compressor according to the present invention provides a reduction in its overall height to be remarkably smaller than that of the related art due to the following reasons.

First of all, the boss 21 of the crankcase 20 is provided to be disposed in the hollow portion 30*a* of the stator 30 of the rotor 40. Hence, the overall height of the scroll compressor can be reduced as much as the length of the boss 21 embedded in the hollow portion 30*a*.

Secondly, since the rotor 40 is provided at a position different from that of the boss 21 of the crankcase 20, it is able to avoid the interference between the upper counterweight 61 and boss 21 even if the upper counterweight is provided on the top of the rotor 40. The present invention need not secure an additional space as high as the height of the counterweight, thereby enabling a reduction in the overall height of the scroll compressor.

Thirdly, when the eccentric force cancellation means is the balance holes, the upper counterweight is unnecessary to be provided on the top of the rotor 40, thereby enabling a reduction in the overall height of the scroll compressor as much as the space for holding the counterweight.

Finally, since an outer diameter of the rotor 40 of the outer rotor type motor of the present invention is greater than that of the inner rotor type motor of the related art, it is able to reduce a mass m in inverse proportion to a distance r between a rotation center and a weight center of the counterweight using the equation of '$F=mr\omega^2$' for finding a centrifugal force of the counter weight to cancel out the eccentric force. In other words, assuming that the same centrifugal force is attained, the rotor 40 of the present invention has the diameter relatively greater than that of the related art to reduce the mass of the counterweight relatively. In this case, the reduction of the mass means that the size or height of the counterweight of the same material can be decreased. Hence, the overall height of the scroll compressor can be reduced. Meanwhile, if the eccentric force cancellation means is the balance hole, the same principle is applicable to reduce the overall height of the scroll compressor.

Accordingly, the scroll compressor according to the present invention has the following effects or advantages.

First of all, the present invention decreases the height of the scroll compressor, thereby enabling a reduction in product cost as well as making efficient use of the space of the system such as a refrigerator, an air conditioner, or the like.

Secondly, since the outer diameter of the rotor of the present invention is greater than that of the related art, the torque can be increased in proportion to the location of the gap between the inner circumferential surface of the rotor and the outer circumferential surface of the stator.

Thirdly, the present invention enables a reduction in the size and weight of the counterweights if the eccentric force cancellation means of the present invention is constructed with the counterweights. And, the present invention enables a reduction in the weight of the compressor remarkably if the eccentric force cancellation means of the present invention is constructed with the balance holes.

Fourthly, the counterweights which was an additional in the related art are removed from the compressor to reduce the product cost as well as simplify the number of the assembly process if the eccentric force cancellation means of the present invention is constructed with the balance holes.

Fifthly, the sub-frame which was an additional in the related art can be removed from the compressor to reduce the product cost as well as simplify the number of the assembly process if the crankshaft support is constructed with the thrust face and portions.

Finally, the present invention includes the oil guide member to return the oil to the inner lower side of the compressor housing without the dispersion of the oil after lubrication, thereby enabling preventing the pressure and volume efficiency of the scroll compressor from decreasing.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A scroll compressor comprising:

a compressor housing forming an exterior of the compressor;

a crankcase fixed inside the compressor housing, a boss is formed at a central portion of the crankcase to protrude downward and a bearing hole is formed in a center of the crankcase;

a stator having a hollow shape is fixed to a lower side of the crankcase;

a rotor provided to maintain a clearance between an outer circumferential surface of the stator and an inner circumferential surface of the rotor;

a crankshaft positioned to pass through the bearing hole and fixed to the rotor to revolve together with the rotor and an eccentric pin is formed on an upper side of the crankshaft;

a orbiting scroll connected to the eccentric pin; and a fixed scroll fixed to an upper side of the crankcase to form a compression chamber together with the orbiting scroll.

2. The scroll compressor of claim 1, wherein the boss of the crankcase is positioned in the hollow portion of the stator.

3. The scroll compressor of claim 1, wherein the stator is screw-coupled with a bottom of the crankcase to be fixed thereto.

4. The scroll compressor of claim 2, wherein an inner circumferential surface of the stator is force-fit into an outer circumferential surface of the boss of the crankcase to be fixed to the crankcase.

5. The scroll compressor of claim 1, wherein at least one balance hole is formed in the rotor.

6. The scroll compressor of claim 5, wherein the at least one balance hole comprises at least one upper balance hole formed on an upper side of a circumference of the rotor in a same direction of an eccentric direction of the eccentric pin of the crankshaft.

7. The scroll compressor of claim 5, wherein the at least one balance hole comprises at least one lower balance hole formed on a lower side of a circumference of the rotor in a direction opposite to an eccentric direction of the eccentric pin of the crankshaft.

8. The scroll compressor of claim 5, wherein the rotor comprises:

a cylindrical rotor housing having an opening at an upper side; and a rotor conductor fitted in an inner circumferential surface of the rotor housing.

9. The scroll compressor of claim 8, wherein at least one interconnecting hole configured to have an oil or gas pass therethrough is formed in a bottom of the rotor housing.

10. The scroll compressor of claim 8, wherein at least one balance hole is further formed in the rotor housing.

11. The scroll compressor of claim 10, wherein the at least one balance hole comprises at least one upper balance hole formed on an upper side of a circumference of the rotor in a same direction of an eccentric direction of the eccentric pin of the crankshaft.

12. The scroll compressor of claim 10, wherein the at least one balance hole comprises at least one lower balance hole formed on a lower side of a circumference of the rotor in a direction opposite to an eccentric direction of the eccentric pin of the crankshaft.

13. The scroll compressor of claim 1, further comprising a sub-frame provided at a lower side of the crankshaft to support a lower end of the crankshaft.

14. The scroll compressor of claim 1, further comprising:

a thrust face formed on an upper side of the bearing hole of the crankcase to have a step difference with another portion of the upper side; and a thrust portion protruding from a circumference of the crankshaft, wherein a lower face of the thrust portion is supported by the thrust face.

15. The scroll compressor of claim 14, wherein the thrust portion protrudes along the circumference of the crankshaft on a boundary of a lower face of the eccentric pin of the crankshaft.

16. The scroll compressor of claim 1, further comprising:

an oil supplying path passing through the crankshaft in an upper/lower direction;

an oil return path passing through the crankcase from a center towards an outside; and an oil guide member guiding oil from the oil return path to a lower side of the rotor.

17. The scroll compressor of claim 16, wherein the oil guide member is a channel type guide plate having an opening formed along a length direction of one side toward an inner wall of the compressor housing.

18. The scroll compressor of claim 17, wherein an upper side of the guide plate extends gradually toward an edge of the guide plate.

19. The scroll compressor of claim 16, wherein the oil guide member is a guide pipe having one end connected to the oil return path and the other end disposed in a space of the lower side of the rotor.

20. The scroll compressor of claim 19, wherein the guide pipe is provided at least in part out side of the compressor housing.

* * * * *